United States Patent [19]

Sato

[11] Patent Number: 5,074,688

[45] Date of Patent: Dec. 24, 1991

[54] STRUCTURE FOR MOUNTING PRINTING HEAD

[75] Inventor: Hiroyuki Sato, Tokyo, Japan

[73] Assignee: Seikosha Co., Ltd., Tokyo, Japan

[21] Appl. No.: 447,289

[22] Filed: Dec. 7, 1989

[30] Foreign Application Priority Data

Dec. 9, 1988 [JP] Japan ..... 63-311612

[51] Int. Cl.[5] ..... B41J 1/60

[52] U.S. Cl. ..... 400/175; 400/139; 400/692

[58] Field of Search ..... 400/139–142, 400/174, 175, 692, 352, 353, 354, 354.3, 355; 403/121

[56] References Cited

U.S. PATENT DOCUMENTS 4,408,909 10/1983 Asano et al. ..... 400/175
4,576,496 3/1986 Schwarz et al. ..... 400/354
4,708,502 11/1987 Murakami ..... 400/175

FOREIGN PATENT DOCUMENTS 178255 10/1984 Japan ..... 400/175
224380 12/1984 Japan ..... 400/175

OTHER PUBLICATIONS

IBM Tech. Disclosure Bulletin, vol. 29, No. 3, Aug. 1986.

*Primary Examiner*—Edgar S. Burr
*Assistant Examiner*—Ren Yan
*Attorney, Agent, or Firm*—Jordan and Hamburg

[57] ABSTRACT

A structure for mounting a printing head includes a printing head provided with engaging projections, while a carriage which mounts the printing head is formed with engaging grooves engaging with the projections. Engaging surfaces on the grooves and the projections are subject to the reaction by a platen. The carriage has a lock means for preventing separation of the projections from the grooves, the lock means including a leaf spring, a lock lever and support means.

23 Claims, 5 Drawing Sheets

STRUCTURE FOR MOUNTING PRINTING HEAD

BACKGROUND OF THE INVENTION

The present invention relates to a structure for mounting a printing head of a printer.

A convention printing head is mounted at a top part of an upper surface of a carriage and is fixed thereto with a screw to assume an overall L-like configuration (e.g., Japanese Patent Laid-Open No. 61-109757).

When initiating a printing operation, the printing head is subjected to a reaction from a platen and tends to incline backwards. For this reason, the printing head does not sufficiently exhibit its printing capability, resulting in such a defect that a stable printing quality cannot be obtained. In addition, the configuration in which to fix the printing head with the screw becomes intricate when the user replaces the printing head. It is therefore a common practice to perform the replacement thereof at a workshop which services printers.

Accordingly, it is a primary object of the present invention to provide a structure for mounting a printing head, which is capable of providing a stable printing quality and which facilitates the replacement of the printing head.

SUMMARY OF THE INVENTION

A first characteristic arrangement of the invention is that either the printing head or a carriage mounted with the printing head is formed with engaging projections, while the other is provided with engaging grooves adapted to receive and engage the projections, the engaging surfaces of the grooves receiving the projections being so arranged as to receive the reaction produced during the printing operation and to be disposed virtually perpendicularly to the direction of such reaction.

A second characteristic arrangement of the invention is that the engaging projections and the engaging grooves in the first arrangement engage with each other so as to enable disengagement therefrom, and the carriage is provided with a lock means for preventing separation of the projections from the grooves.

A third characteristic arrangement is that the lock means in the second arrangement comprises a leaf spring including a pressing portion for pressing the engaging projections on the engaging surfaces virtually in the direction of reaction and a lock portion for fixing the projections to the insides of the grooves engaging with said projections; a lock lever provided with a lock cam rotatably fitting to the lock portion; and a support means for supporting the lock lever in a predetermined position, the lock cam being adapted to cause the lock portion to engage with the engaging projections while moving the lock portion, resisting the elastic force of the leaf spring, by rotating interlockingly with swinging of the lock lever.

DESCRIPTION OF THE PREFERRED EMBODIMENTS

An embodiment of the present invention will hereinafter be described in detail with reference to the accompanying drawings.

Figure 1:
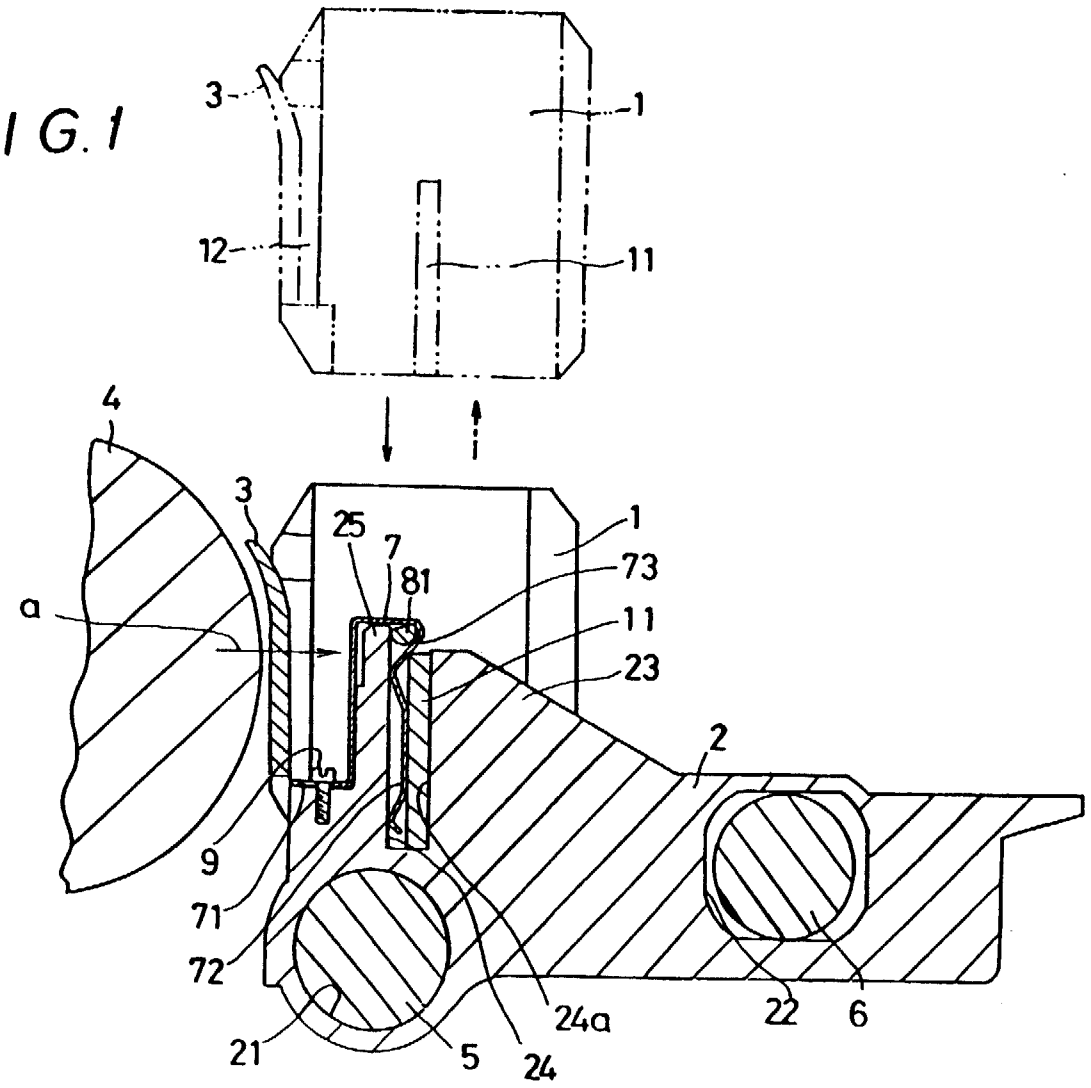
FIG. 1 is a front elevation partially in section according to one embodiment of the invention.
Figure 2:
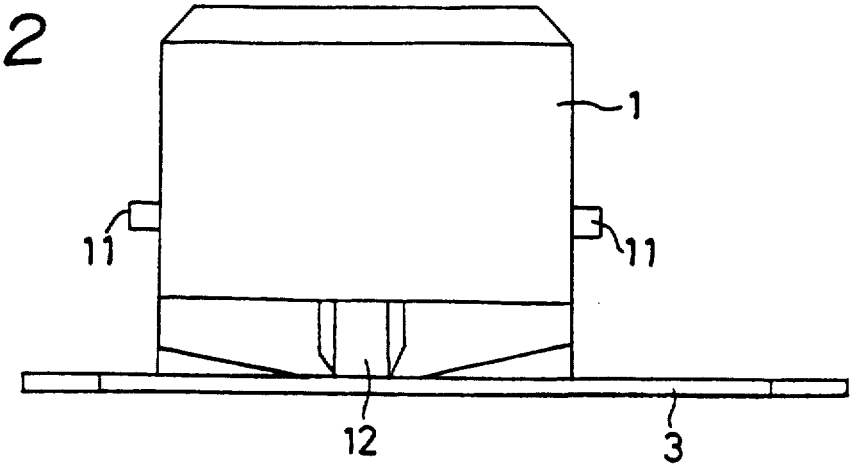
FIG. 2 is a plan view of the printing head.

As illustrated in FIGS. 1 and 2, engaging projections 11 are provided integrally on both side surfaces of a printing head 1 classified as an impact type head and formed with a protrusion 12 at the center of its front surface. The protrusion 12 accommodates printing non-illustrated wires slidably arranged therein. A central portion of a ribbon guide 3 located in front of the printing head 1 is perforated with a non-illustrated through-hole in which the protrusion 12 is positioned. Upper ends of the engaging projections 11 are set at the same level or higher than the printing wires. As is broadly known, a printing is operated by having the printing wires strike a platen 4.

Figure 3:
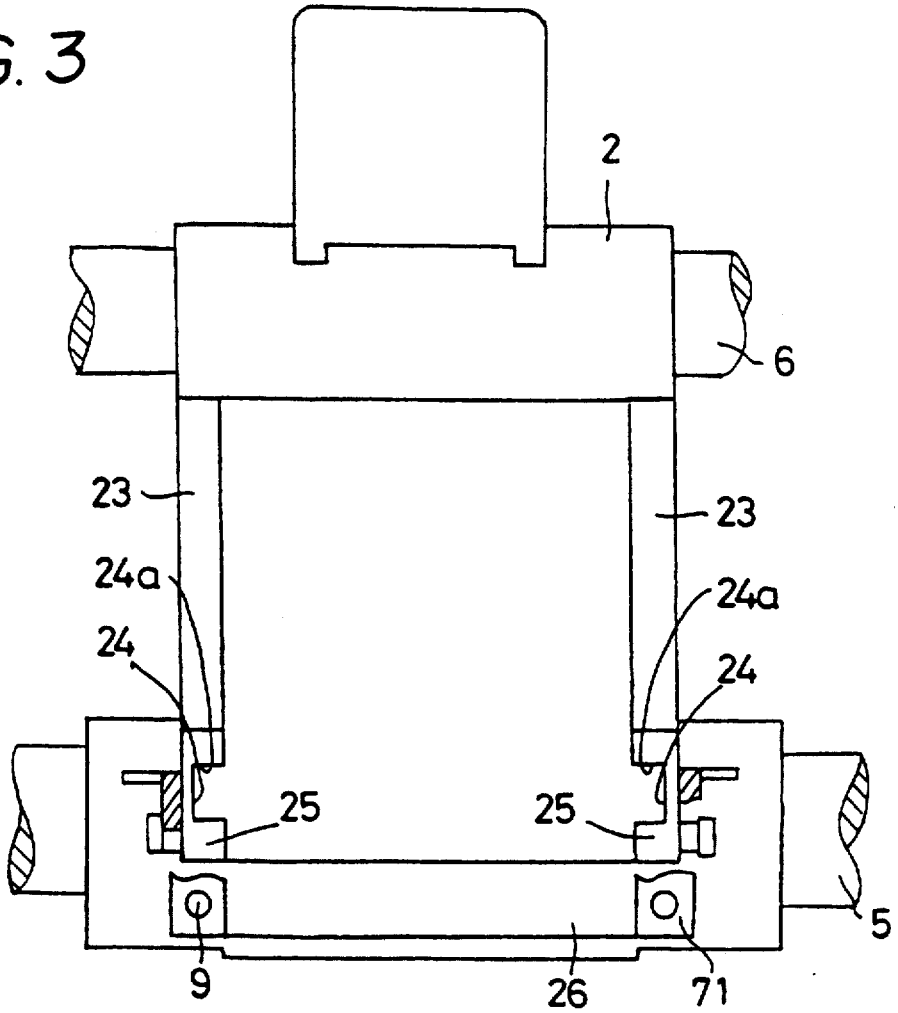
FIG. 3 is a plan view of the carriage.

A carriage 2 is, as shown in FIGS. 1 and 3, provided with guide holes 21 and 22 in its front and rear parts and is movable bilaterally by means of guide shafts fitted therein. Formed integrally on both sides of the carriage 2 are side walls 23, the inner surfaces of which are, as shown in FIG. 3, formed with engaging grooves 24. The engaging grooves 24 are, as indicated by solid lines of FIG. 1, adapted to receive and engage the engaging projections 11 of the printing head 1. In this embodiment, the width of the engaging groove 24 is almost twice as large as that of the engaging projection 11, while the depth thereof is at least the same or greater than a length of the projection 11.

When mounting the printing head 1 on the carriage 2, as shown in FIG. 1, the engaging projections 11 are inserted into the engaging grooves 24 of the carriage 2 while moving the head 1 downwardly from the position shown with chain lines.

Engaging surfaces 24*a* between the engaging grooves 24 and the engaging projections 11 are virtually orthogonal to the direction of arrow "a" shown in FIG. 1 and which represents the reaction of the platen 4 when the printing head 1 performs the printing process in which the printing wires impact the platen. Thus, the engaging surfaces 24*a* are subjected to the reaction forces from the front.

A description will next focus on a lock means for preventing separation of the printing head 1 from the carriage 2 and for maintaining the mounting condition of this head.

Figure 4:
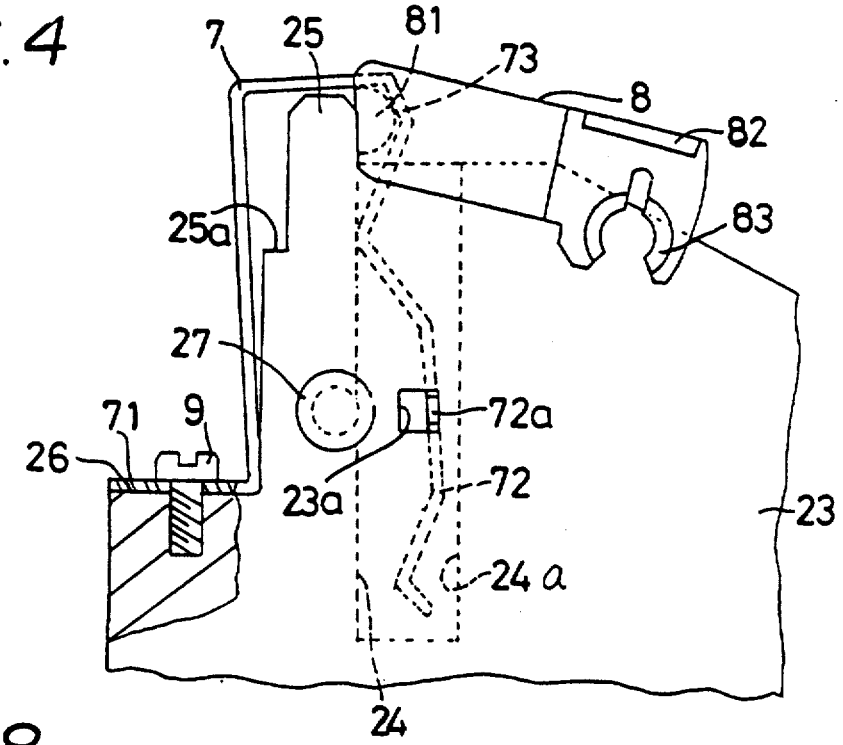
FIG. 4 is a partially enlarged front elevational view of the carriage mounted without the printing head.

Turning to FIGS. 3 and 4, the lock means comprises a leaf spring 7 having a floating end inserted into the engaging grooves 24 of the carriage 2, a lock lever 8 engaging the leaf spring and retaining means (27 and 83) for retaining the locking lever 8 in a predetermined position.

The mounting position and the configuration of the leaf spring 7 will now be explained. A step portion 26, as shown in FIG. 4, is integrally disposed at the bottom of a section wall 25 outwardly provided with a small step portion 25*a* in front of the engaging grooves 24 of the carriage 2.

Figure 5:
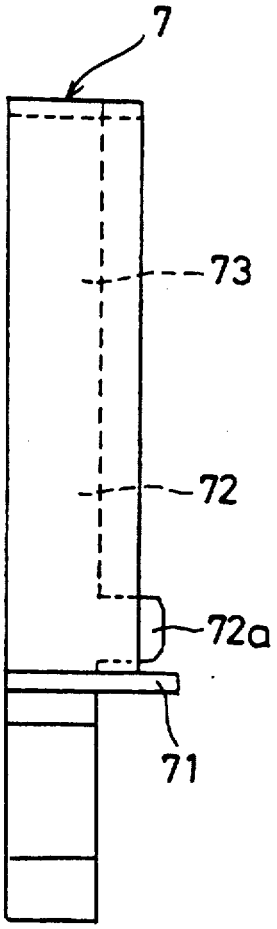
FIG. 5 is an enlarged front elevation of a leaf spring.

A screw hole is provided in an end portion 71 of the leaf spring 7. This end portion is in turn disposed on the upper surface of the step portion 26 and fixed thereto with a screw 9. The leaf spring is bent astride the section wall 25, in which state a gap is formed between the leaf spring 7 and an exterior of the section wall. Inserted into the engaging grooves 24 are ends of leaf spring 7 which are formed with pressing portions 72 on which lock portions 73 crooked in an L-shape (or alternatively S-shape) are provided. The pressing portion 72 includes engaging portions 72*a* (FIG. 5) each protruding sideways. The engaging portions 72*a* engage engaging holes 23*a* (FIG. 4) formed in the side walls 23, such that the leaf spring is thereby set in a predetermined position within the engaging groove, thus fitting the leaf spring therein.

Figure 6:
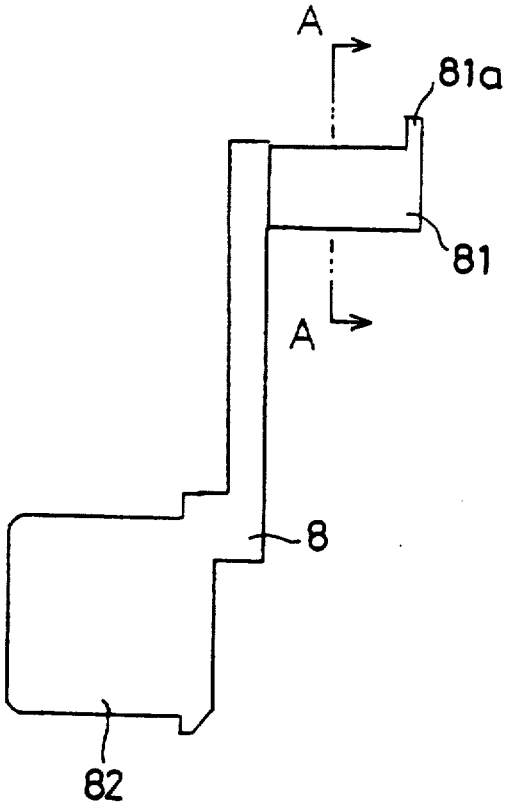
FIG. 6 is an enlarged front elevation of a lock lever.
Figure 7:
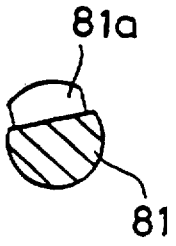
FIG. 7 is a sectional view taken along the line A—A of FIG. 6.

Next, the construction of the locking lever 8 will be described with reference to FIGS. 4, 6 and 7. Referring to FIG. 6, one end of the locking lever 8 is formed integrally with a locking cam 81 extending sideways, while the other end thereof is formed with a knob portion 82 on the side opposite to the locking cam 81.

The locking cam 81 has a configuration in section that an outer peripheral portion of a cylinder is partly cut away, thus providing a small diameter portion and a large diameter portion.

The support means for supporting the locking lever 8 in a predetermined position will now be described. Referring to FIG. 4, an engaging portion 83 formed with an opening at its lower end and having a circular shape in internal configuration is disposed downwardly of the knob portion 82 of the locking lever 8. The engaging portion 83 serves as one of the support means. Provided on an outer surface of the side wall 23 is a lock projection 27 serving as the other support means for supporting the locking lever 8 in the predetermined position when the engaging portion 83 comes into engagement. The external configuration of the lock projection 27 corresponds to an internal shape of the engaging portion 83. When the locking lever 8 swings about the locking cam 81, the lock projection 27 enters the opening of the engaging portion 83 while flexing the engaging portion 83 which in turn engages the lock projection 27 to secure the position of the locking lever 8. The locking cam 81 includes, as illustrated in FIGS. 6 and 7, an engaging portion 81*a* extending from a part of the end thereof.

The locking cam 81 of the locking lever 8 is inserted into the gap between the lock portion 73 of the leaf spring 7 and the section wall 25, with the result that the engaging portion 81*a* engages with the lock portion 73 enough not to separate therefrom. This is illustrated in FIG. 4.

The operation of mounting the printing head 1 on the carriage 2 will now be described. With the carriage in a state as shown in FIG. 4, the printing head 1 is, as illustrated in FIG. 1, moved downwardly from the position drawn in chain line, and the projections 11 are received into the engaging grooves 24 of the carriage 2. As a result, the leaf spring 7 is deformed resisting its own elastic force while the pressing portion 72 acts to press the engaging projections 11 on the engaging surfaces 24*a* of the grooves 24.

Figure 8:
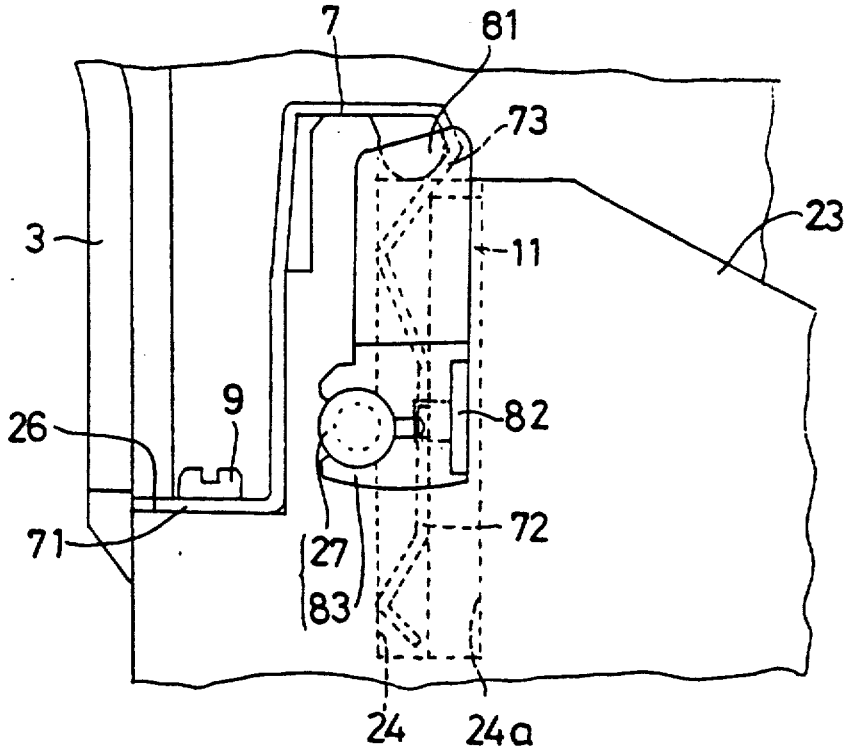
FIG. 8 is a partially enlarged front elevational view of the carriage with the printing head mounted thereon.

When swinging the locking lever 8 clockwise to the position shown in FIG. 8, the engaging portion 83 engages the projection 27. At this time, the lock cam 81 of the locking lever 8 rotates interlocking with swinging of the locking lever, thereby causing, as shown in FIG. 8, displacement of the lock portion 73 with the aid of the locking cam 81 while resisting the elastic force of the leaf spring 7. Angular portions of the upper ends of the engaging projections 11 are thus pressed to prevent the separation of the engaging projections 11.

When initiating the printing process, the whole engaging surfaces 24*a* of the engaging grooves 24 receive, from the front via the engaging projections 11, the reaction (indicated by the arrow "a" in FIG. 1) that the printing head 1 is to undergo as a result of printing on the platen by the printing wires hitting the platen 4, whereby the printing head 1 is not inclined at all.

The removal or separation of the printing head 1 from the carriage 2 entails the steps of disengaging the engaging portion 83 of the locking lever 8 from the lock projection 27, rotating it counterclockwise from the position depicted in FIG. 8 to the position shown in FIG. 4 and pulling up the printing head 1 from the carriage 2.

According to the present invention, the engaging surfaces of the engaging grooves with which the engaging projections engage are so formed as to be virtually orthogonal to the direction of reaction during the printing process. These engaging surfaces are adapted to undergo the reaction which operates on the printing head from the front, and hence the printing head is not inclined backwards by the reaction. For this reason, it is possible to obtain sufficient printing capability of the printing head and at the same time obtain stable printing quality. In addition, the printing head can be demounted from the carriage with facility for replacement thereof. The leaf spring presses the engaging projections onto the engaging surfaces in the direction of the reaction, and further, the lock portion presses the engaging projections towards the bottom surface of the carriage through the locking cam, thereby avoiding any backlash between the printing head and the carriage.

Although the present invention has been described through specific terms, it should be noted here that the described embodiment is not necessarily exclusive and that various changes and modifications may be imparted thereto without departing from the scope of the invention which is limited solely by the appended claims.

What I claim is:

1. A structure for mounting a printing head on a carriage of a printer having a platen and wherein a printing head has printing wires which are operable to strike said platen, said printing head having sides and having projections on each of said sides, and a carriage means having grooves receiving said projections, said projections and grooves having engaging flat surfaces which extend substantially to the level of said printing wires, said engaging flat surfaces being disposed in a plane substantially perpendicular to the direction of the reaction force to which said printing head is subjected to when said printing wires strikes said platen such that said reaction force is transmitted to said engaging flat surfaces and backward movement of said printing head by said reaction force is precluded by said engaging flat surfaces to thereby achieve stable printing quality.

2. A structure according to claim 1 wherein said projections and said grooves extend linearly, said printing head being mountable and demountable from said carriage by linearly sliding said projections into and out of said grooves.

3. A structure according to claim 1 wherein said projections consist of at least two elongated linear projections and said grooves consist of at least two elongated linear grooves, said printer being generally linearly slidable when being mounted on said carriage by sliding said at least two linear projections in said at least two linear grooves.

4. A structure according to claim 1 further comprising spring means extending into said grooves in which said projections are received for biasing said engaging flat surfaces of said projections and said grooves together.

5. A structure according to claim 1 further comprising spring means extending into said grooves in which said projections are received for engaging said projections and biasing said engaging surfaces of said projections into engagement with said engaging surfaces of said grooves.

6. A structure according to claim 5 further comprising locking means for preventing demounting of said printer head from said carriage by preventing said projections from sliding out of said grooves, said locking means being cooperably engageable with said spring means to biasingly retain said projections within said grooves.

7. A structure according to claim 6 wherein said locking means comprises a pivotal lever pivotal between a lever locking position and a lever non-locking position, said pivotal lever when in said lever locking position being operable to prevent said projections from being withdrawn from said grooves, said pivotal lever when in said lever non-locking position permitting withdrawal of said projections from said grooves.

8. A structure according to claim 7 wherein said locking means further comprises retaining means engageable with said pivotal lever to retain said pivotal lever in said lever locking position.

9. A structure according to claim 8 wherein said retaining means comprises a retaining member on said pivotal lever and another retaining member on said carriage, one of said retaining members resiliently gripping the other retaining member when said pivotal lever is in said lever locking position.

10. A structure according to claim 5 wherein said spring means has a generally overall, inverted, U-shaped configuration having two downwardly depending leg portions, one of said leg portions being disposed in said groove in which said projections are received, the other of said leg portion having fastening means for fastening said other leg portion to said carriage.

11. A structure according to claim 5 wherein said spring means is a leaf spring having lateral protrusions, and slots in said carriage juxtaposed to said grooves for receiving said lateral protrusions to thereby retain said spring means in said grooves in which said projections are received.

12. A structure according to claim 1 wherein said grooves in which said projections are received having a front portion and a rear portion, said front portion being closer to said platen than said rear portion, said projections being disposed in said rear portion, and spring means in said front portion biasing said projections against said engaging surfaces of said grooves.

13. A structure according to claim 1, wherein said engaging flat surfaces extend at least to the same level as said printing wires.

14. A structure according to claim 1, wherein said engaging first surfaces extend to a level higher than said printing wires.

15. In a printer, the combination comprising a printing head on a carriage and a platen, said printing head having operable means to strike said platen in a striking direction to effect printing, said printing head being subjected to a reaction force opposite to said striking direction, said printing head having two opposite sides, first engaging means on each of said sides, said carriage having second engaging mans engaging said first engaging means, said first and second engaging means comprising engaging flat surfaces disposed in a plane substantially perpendicular to the direction of said reaction force, said engaging flat surfaces extending substantially to the level of said operable means, said reaction force being transmitted to said engaging flat surfaces such that backward movement of said printing head by said reaction force is precluded by said engaging flat surfaces to thereby achieve stable printing quality.

16. In a printer according to claim 15 wherein one of said first and second engaging means comprises projections and the other of said first and second engaging means comprises grooves which receive said projections.

17. In a printer according to claim 16 wherein said projections are elongated projections having longitudinal extending flat side walls, said grooves being elongated grooves having longitudinal extending flat side walls, said longitudinal extending flat side walls of said projections and said grooves constituting said engaging flat surfaces.

18. A structure for mounting a printing head on a carriage of a printer having a platen and wherein said printing head is operable to strike said platen, comprising a printing head having sides and having projections on each of said sides, a carriage means having grooves receiving said projections, said projections and grooves having engaging flat surfaces disposed in a plane substantially perpendicular to the direction of the reaction force to which said printer is subjected to when said printing head strikes said platen, locking means for preventing demounting of said printer head from said carriage by preventing said projections from sliding out of said grooves, said locking means comprising a pivotal lever pivotal between a lever locking position and a lever non-locking position, said pivotal lever when in said lever locking position being operable to prevent said projections from being withdrawn from said grooves, said pivotal lever when in said lever non-locking position permitting withdrawal of said projections from said grooves, spring means biasing said engaging surfaces of said projections into engagement with said engaging surfaces of said grooves, said carriage having a first engageable part and said spring means having a second engageable part, said pivotal lever having a cam means, said cam means being disposed between said first and second engageable parts, said cam means being biased against said first engageable part by said second engageable part of said spring means, said cam means being rotated between a cam lock position and a cam non-lock position, said cam means being in said cam lock position when said pivotal lever is in said lever locking position, said cam means being in said cam-lock position when said pivotal lever is in said lever non-lock position, said cam means having an axis of rotation, said pivotal lever being pivotal about said axis of rotation.

19. A structure according to claim 18 wherein said cam means when is said cam lock position moves said second engageable part of said spring means to a position overlying one end of said groove to prevent said projection from being withdrawn from said groove.

20. A structure according to claim 18, whereby said cam means when in said cam non-lock position is operable to dispose said second engageable part of said spring means in a position to enable said projections to be inserted into said grooves.

21. A structure according to claim 18 wherein said second engageable part of said spring means has a generally V-shaped configuration.

22. A structure according to claim 18 wherein said cam means is disposed in a position overlying said groove.

23. A structure for mounting a printing head on a carriage of a printer having a platen and wherein a printing head is operable to strike said platen, said printing head having sides and having projections on each of said sides, and a carriage means having grooves receiving said projections, said projections and grooves being engaging flat surfaces disposed in a plane substantially perpendicular to the direction of the reaction force to which said printer is subjected to when said printing head strikes said platen, locking means for preventing demounting of said printer head from said carriage by preventing said projections from sliding out of said grooves, said locking means comprising a pivotal lever pivotal between a lever locking position and a lever non-locking position, said pivotal lever when in said lever locking position being operable to prevent said projections from being withdrawn from said grooves, said pivotal lever when in said lever nonlocking position permitting withdrawal of said projections from said grooves, said locking means further comprising spring means biasing said engaging surfaces of said projections into engagement with said engaging surfaces of said grooves, said pivotal lever when in said locking position engaging said spring means to dispose said spring means in a position in which said spring means biases said projections in a direction perpendicular to said engaging flat surfaces and also in a direction parallel to said flat surfaces and also in a direction parallel to said engaging flat surfaces.

* * * * *